US010969167B2

(12) United States Patent
Cavagne et al.

(10) Patent No.: US 10,969,167 B2
(45) Date of Patent: Apr. 6, 2021

(54) APPARATUS FOR THE DISTILLATION OF AIR BY CRYOGENIC DISTILLATION

(71) Applicant: L'Air Liquide, Societe Anonyme pour l'Etude et l'Exploitation des Procedes Georges Claude, Paris (FR)

(72) Inventors: Patrice Cavagne, Le Perreux (FR); Remy Kurtz, Cracow (PL)

(73) Assignee: L'Air Liquide Société Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 0 days.

(21) Appl. No.: 16/655,977

(22) Filed: Oct. 17, 2019

(65) Prior Publication Data

US 2020/0132368 A1 Apr. 30, 2020

(30) Foreign Application Priority Data

Oct. 29, 2018 (CN) ..... 201821756409.6

(51) Int. Cl.
*F25J 3/04* (2006.01)

(52) U.S. Cl.
CPC ..... *F25J 3/04054* (2013.01); *F25J 3/0429* (2013.01); *F25J 3/0443* (2013.01); (Continued)

(58) Field of Classification Search
CPC ..... Y10S 62/905; Y10S 2/924; Y10S 62/911; F25J 3/04054; F25J 3/04084; (Continued)

(56) References Cited

U.S. PATENT DOCUMENTS 5,426,946 A * 6/1995 Corduan ..... F25J 3/0423 62/643
6,560,992 B2 * 5/2003 Corduan ..... F25J 3/04303 62/643

(Continued)

FOREIGN PATENT DOCUMENTS

| | | |
|---|---|---|
| CN | 102 338 546 | 2/2012 |
| DE | 10 2012 006479 | 10/2013 |
| EP | 2 645 032 | 10/2013 |

*Primary Examiner* — Mark Laurenzi
*Assistant Examiner* — Mickey H France
(74) *Attorney, Agent, or Firm* — Justin K. Murray

(57) ABSTRACT

An apparatus for the distillation of air by cryogenic distillation is provided. The apparatus can include an enclosure; a first distillation column configured to operate at a first pressure; a second distillation column configured to operate at a second pressure that is lower than the first pressure, the second distillation column being placed above the first distillation column and forming therewith a double column; a subcooling heat exchanger configured to cool at least one liquid from the first distillation column upstream of the second distillation column and configured to warm a gaseous nitrogen stream from the second distillation column; and an argon column configured to separate an argon enriched stream from the second distillation column and configured to produce an argon rich stream. In certain embodiments, the first distillation column, the second distillation column, the argon column and the subcooling heat exchanger are disposed within the enclosure, and/or the subcooling heat exchanger is disposed directly underneath the first distillation column or the argon column.

9 Claims, 1 Drawing Sheet

(52) U.S. Cl.
CPC ..... *F25J 3/04084* (2013.01); *F25J 3/04254* (2013.01); *F25J 3/04303* (2013.01); *F25J 3/04793* (2013.01); *F25J 3/04872* (2013.01); *F25J 3/04951* (2013.01); *F25J 2200/04* (2013.01); *F25J 2200/34* (2013.01); *F25J 2200/52* (2013.01); *F25J 2200/54* (2013.01); *F25J 2210/40* (2013.01); *F25J 2215/40* (2013.01); *F25J 2215/42* (2013.01); *F25J 2215/50* (2013.01); *F25J 2215/58* (2013.01); *F25J 2245/50* (2013.01)

(58) Field of Classification Search
CPC .... F25J 3/04254; F25J 3/0429; F25J 3/04303; F25J 3/0443; F25J 3/04793; F25J 3/04872; F25J 3/04951; F25J 2200/04; F25J 2200/34; F25J 2200/52; F25J 2200/54; F25J 2210/40; F25J 2215/40; F25J 2215/42; F25J 2215/50; F25J 2215/58; F25J 2245/50
USPC ..... 62/643, 905, 911, 924
See application file for complete search history.

(56) References Cited

U.S. PATENT DOCUMENTS

2001/0001364 A1* 5/2001 Bruder ..... F25J 3/0489 62/643
2010/0139318 A1* 6/2010 Cavagne ..... F25J 3/04412 62/643

* cited by examiner

APPARATUS FOR THE DISTILLATION OF AIR BY CRYOGENIC DISTILLATION

CROSS REFERENCE TO RELATED APPLICATIONS

This application claims the benefit of priority under 35 U.S.C. § 119 (a) and (b) to Chinese patent application No. CN201821756409.6, filed Oct. 29, 2018, the entire contents of which are incorporated herein by reference.

FIELD OF THE INVENTION

The present invention relates to an apparatus for the distillation of air by cryogenic distillation.

BACKGROUND OF THE INVENTION

It is common to separate air in a double distillation column including a first column operating at a medium pressure and a second column operating at a low pressure. A liquid enriched in oxygen is sent from the first column to the second column. A liquid enriched in nitrogen is sent from the first column to the second column. One or both of these liquids may be cooled in a heat exchanger called a subcooler by heat exchange with a gaseous nitrogen stream from the low pressure column.

The second column is placed above the first column and generally forms a common structure called the double distillation column.

Where it is required to separate argon, an argon column is provided taking an argon enriched gas from an intermediate region of the low pressure column. Pure argon can then be removed from the top of the argon column.

Each of the columns requires to be insulated in an enclosure containing an insulating material such as perlite.

Generally in the past, the subcooling heat exchanger has been provided within a separate enclosure from the columns, being contained in the same enclosure as the main heat exchanger which cools the feed air. This means that complex assembly work has to be done on site in order to connect the subcooling heat exchanger to the columns. This is expensive and time-consuming.

SUMMARY OF THE INVENTION

According to the invention, there is provided an apparatus for the distillation of air by cryogenic distillation comprising an enclosure, a first distillation column operating at a first pressure, a second distillation column operating at a second pressure, the second distillation column being placed above the first distillation column and forming therewith a double column, a subcooling heat exchanger for cooling at least one liquid from the first distillation column upstream of the second distillation column and for warming a gaseous nitrogen stream from the second distillation column, an argon column for separating an argon enriched stream from the second distillation column and for producing an argon rich stream, the first and second columns, the argon column and the subcooling heat exchanger being within the enclosure and the subcooling heat exchanger being placed directly underneath the first distillation column or the argon column, within a supporting structure.

This apparatus is particularly compact.

Preferably, embodiments of the invention may also include the following features:

the double column is shorter than the argon column;

the argon column is shorter than the double column;

the base of the argon column is at the same elevation as the base of the subcooler;

the apparatus comprises a heat exchanger for cooling air to feed the first column, said heat exchanger being outside the enclosure;

the double column is shorter than the argon column and the subcooling heat exchanger is placed directly underneath the first distillation column;

the first and second distillation columns and possibly the subcooling heat exchanger are supported by the supporting structure;

the first argon column and possibly the subcooling heat exchanger is/are supported by the supporting structure;

the base of the argon column is lower than the top of the supporting structure;

the sum of the heights of the supporting structure and the first and second distillation columns is substantially equal to the sum of the heights of the argon column and a supporting structure of the argon column;

the double column is longer than the argon column and the subcooling heat exchanger is placed directly underneath the argon column;

the base of the argon column is supported by the supporting structure;

the sum of the heights of the argon column and the supporting structure is substantially equal to the sum of the heights of the double column and a supporting structure of the double column; and/or the apparatus comprises a heat exchanger for cooling air to feed the first column, said heat exchanger being outside the enclosure.

The invention will be described in greater detail with reference to the figures, which show a simplified layout of the apparatus.

BRIEF DESCRIPTION OF THE DRAWINGS

Further features, advantages and possible applications of the invention are apparent from the following description of working and numerical examples and from the drawings. All described and/or depicted features on their own or in any desired combination form the subject matter of the invention, irrespective of the way in which they are combined in the claims the way in which said claims refer back to one another.

DETAILED DESCRIPTION OF THE INVENTION

Figures 1, 2:
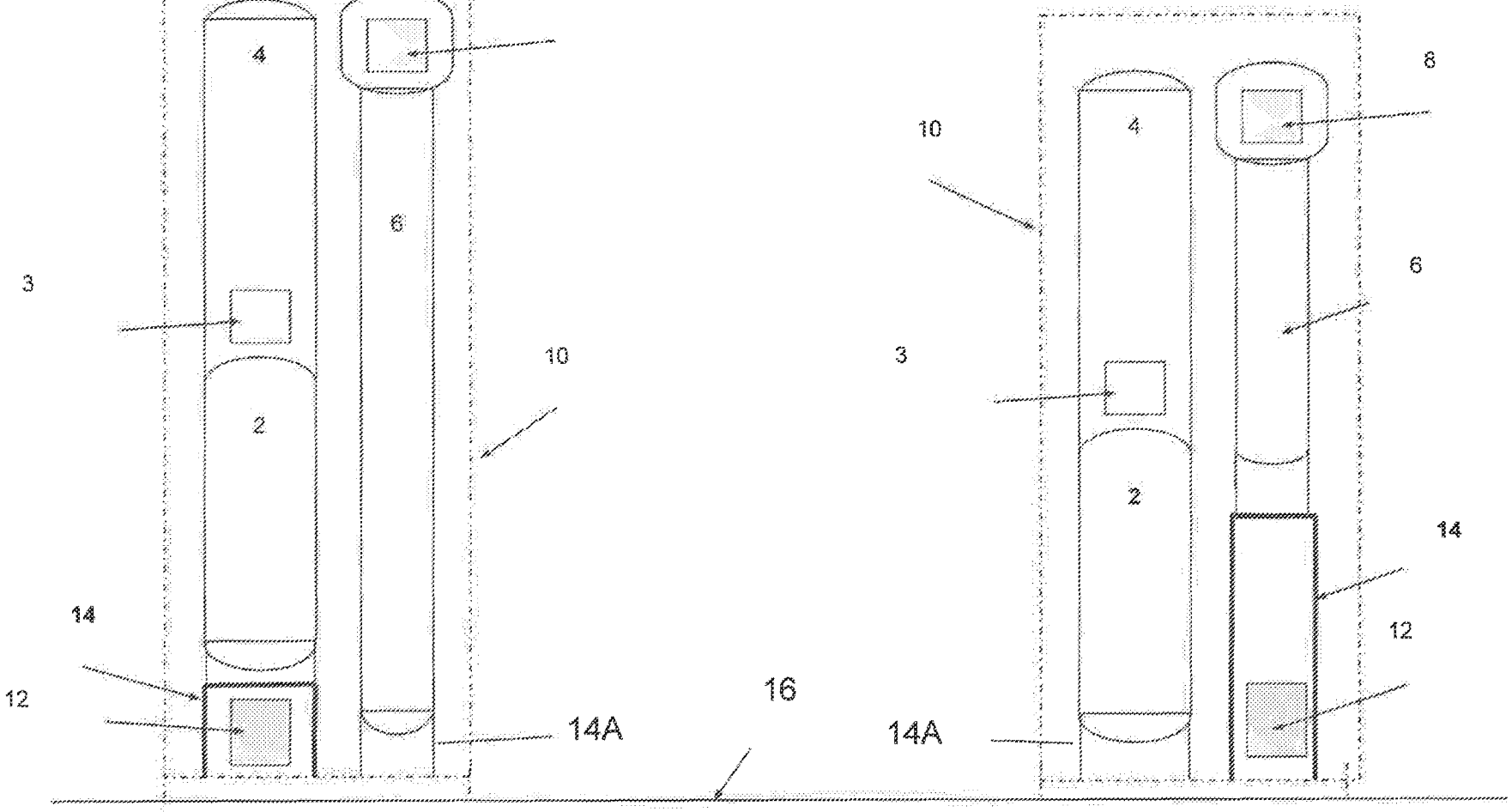
FIG. 1 provides an embodiment of the present invention.
FIG. 2 provides another embodiment of the present invention.

In FIG. 1, the apparatus includes a double distillation column composed of a first column 2 operating at a medium pressure and a second column 4 operating at a low pressure. Air to be distilled is fed to the first column 2. A liquid enriched in oxygen is sent from the first column 2 to the second column 4. A liquid enriched in nitrogen is sent from the first column 2 to the second column 4. One or both of these liquids may be cooled in a subcooling heat exchanger 12 called a subcooler by heat exchange with a gaseous nitrogen stream from the low pressure column.

The second column 4 is placed above the first column 2 and forms a common structure called the double distillation column, the nitrogen from the first column being condensed in a bottom reboiler condenser 3 which provides reboil to the second column.

An argon column 6, taller than the double column 2,4, is provided taking an argon enriched gas from an intermediate region of the low pressure column 4 as feed. Pure argon can then be removed from the top of the argon column 6. Bottom liquid from the argon column 6 is sent back to the second column 4.

The subcooling heat exchanger 12 is placed directly underneath the first column 2 within a supporting structure which maintains the double column 2,4. In this way the total height of the heat exchanger 12 within the supporting structure 14 and the double column 2,4 is substantially the same as that of the argon column 6. In this way the enclosure 10 containing the columns 2,4,6 and the subcooler 12 can be more compact.

The top of the second column 4 is at the same level as the top of the top condenser 8 of argon column 6.

The base of the argon column 6 is substantially at the same level as the middle of supporting structure 14, the argon column being itself maintained above ground 16 by another supporting structure 14A.

The enclosure 10 contains an insulating material such as perlite.

The supporting structure 14 supports columns 2,4 and possibly also the subcooler 12.

The sum of the heights of the supporting structure 14 and the first and second distillation columns 2,4 is substantially equal to the sum of the heights of the argon column 6 and a supporting structure 14A of the argon column.

In FIG. 2, the apparatus includes a double distillation column composed of a first column 2 operating at a medium pressure and a second column 4 operating at a low pressure. Air to be distilled is fed to the first column 2. A liquid enriched in oxygen is sent from the first column 2 to the second column 4. A liquid enriched in nitrogen is sent from the first column 2 to the second column 4. One or both of these liquids may be cooled in a subcooling heat exchanger 12 called a subcooler by heat exchange with a gaseous nitrogen stream from the low pressure column.

The second column 4 is placed above the first column 2 and forms a common structure called the double distillation column, the nitrogen from the first column being condensed in a bottom reboiler condenser 3 which provides reboil to the second column.

An argon column 6, in this case shorter than the double column 2,4, is provided taking an argon enriched gas from an intermediate region of the low pressure column 4 as feed. The height of the argon column 6 may be equal to that of the low pressure column 4. Pure argon can then be removed from the top of the argon column 6. Bottom liquid from the argon column 6 is sent back to the second column 4.

The subcooling heat exchanger 12 is placed directly underneath the argon column 6 within a supporting structure 14 which maintains the argon column 6. In this way the total height of the heat exchanger 12 within the supporting structure 14 and the argon column 6 is substantially the same as that of the double column 2,4. In this way the enclosure 10 containing the columns 2,4,6 and the subcooler 12 can be more compact.

The top of the second column 4 is at the same level as the top of the top condenser of argon column 6.

The base of the argon column 6 is substantially at the same level as the top of the first column 2, the argon column being itself maintained above ground 16 by supporting structure 14.

The enclosure 10 contains an insulating material such as perlite.

The supporting structure 14 supports argon column 6 and possibly also the subcooler 12.

Another supporting structure 14A supports the double column 2,4 above ground 16.

The sum of the heights of the argon column 6 and the supporting structure 14 is substantially equal to the sum of the heights of the double column 2,4 and of a supporting structure 14A for the double column.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. An apparatus for the distillation of air by cryogenic distillation comprising:

an enclosure;

a first distillation column configured to operate at a first pressure;

a second distillation column configured to operate at a second pressure that is lower than the first pressure, the second distillation column being placed above the first distillation column and forming therewith a double column;

a subcooling heat exchanger configured to cool at least one liquid from the first distillation column upstream of the second distillation column and configured to warm a gaseous nitrogen stream from the second distillation column; and an argon column configured to separate an argon enriched stream from the second distillation column and configured to produce an argon rich stream, wherein the first distillation column, the second distillation column, the argon column and the subcooling heat exchanger are disposed within the enclosure, wherein the subcooling heat exchanger is disposed directly underneath the first distillation column or the argon column.

2. The apparatus according to claim 1, wherein the double column is shorter than the argon column and the subcooling heat exchanger is placed directly underneath the first distillation column.

3. The apparatus according to claim 2, wherein the first and second distillation columns and possibly the subcooling heat exchanger are supported by a supporting structure.

4. The apparatus according to claim 3, wherein the base of the argon column is lower than the top of the supporting structure.

5. The apparatus according to claim 1, wherein the sum of the heights of the supporting structure and the first distillation column and the second distillation column are substantially equal to the sum of the heights of the argon column and a supporting structure of the argon column.

6. The apparatus according to claim 1, wherein the double column is longer than the argon column and the subcooling heat exchanger is placed directly underneath the argon column.

7. The apparatus according to claim 6, wherein the base of the argon column and possibly the subcooling heat exchanger is/are supported by a supporting structure.

8. The apparatus according to claim 6, wherein the sum of the heights of the argon column and the supporting structure is substantially equal to the sum of the heights of the double column and of a supporting structure for the double column.

9. The apparatus according to claim 1 further comprising a heat exchanger for cooling air to feed the first column, said heat exchanger being outside the enclosure.

* * * * *